United States Patent [19]

Hansen et al.

[11] Patent Number: 4,747,423

[45] Date of Patent: May 31, 1988

[54] ADJUSTABLE AND REDUCIBLE WALKING AID AND METHOD OF USING SAME

[75] Inventors: Ries B. Hansen, Milwaukee, Wis.; Orlando J. Casariego, Miami Springs, Fla.

[73] Assignee: Ortho-Tech Industries, Inc., New Orleans, La.

[21] Appl. No.: 867,099

[22] Filed: May 27, 1986

[51] Int. Cl.[4] ..... A61H 3/02

[52] U.S. Cl. ..... 135/68

[58] Field of Search ..... 135/65, 68, 69, 74, 135/75, 84, 85; 403/100, 101, 102

[56] References Cited

U.S. PATENT DOCUMENTS

| | | | |
|---|---|---|---|
| Re. 28,067 | 7/1974 | Hyman | 135/74 |
| 469,592 | 2/1892 | Parkes | 403/100 |
| 987,497 | 3/1911 | Shadell et al. | 135/69 |
| 1,534,820 | 4/1925 | Walmsley | 135/74 |
| 2,817,348 | 12/1957 | Holliday, Jr. | 135/69 |
| 3,635,233 | 1/1972 | Robertson | 135/71 |
| 3,655,297 | 4/1972 | Bolen, Jr. et al. | 135/74 |
| 3,730,544 | 5/1973 | Hyman | 135/65 |
| 3,886,962 | 6/1975 | Diamontis | 135/69 |
| 4,253,478 | 3/1981 | Husa | 135/74 |
| 4,437,480 | 3/1984 | Husa | 135/74 |
| 4,527,579 | 7/1985 | Knotter et al. | 135/74 |

FOREIGN PATENT DOCUMENTS

| | | | |
|---|---|---|---|
| 126298 | 1/1932 | Austria | 135/49 |

*Primary Examiner*—Robert A. Hafer
*Assistant Examiner*—Charles H. Sam
*Attorney, Agent, or Firm*—C. Thomas Sylke; John C. Cooper, III; Fred Wiviott

[57] ABSTRACT

A reducible walking aid is disclosed that incorporates three bitubular sections in slidable engagement with one another in the preferred embodiment. The first and third sections are connected via a pair of elastic cables attached to slidable, bidirectional hinge elements anchored to the near ends of the first and third sections, with the cables running through the tubular sections of the second section. To reduce the size of the walking aid, one pulls in opposite directions on the first and second bitubular sections. Once the hinges are generally clear of the second section, the first section is folded over the second section in one direction. The third section is folded in the opposite direction in a similar fashion to accomplish the complete folding of the crutch. To restore the walking aid to its original operating size, one grasps the folded first and third sections and opens them until they are in generally axial alignment with the second section, at which time the first and third sections slide into the second to provide a rigid vertical support. Means are also provided for adjusting the height of the walking aid both below and above the hand grip. The hand grip is of novel design and is adjustable along an infinite number of positions on the second section.

20 Claims, 3 Drawing Sheets

ADJUSTABLE AND REDUCIBLE WALKING AID AND METHOD OF USING SAME

BACKGROUND OF THE INVENTION

1. Field of the Invention

The present invention relates generally to the art of folding or reducing vertical supports, and more particularly to the art of walking aids that are capable of being reduced in size. More specifically, the present invention relates to an orthopedic crutch that can be reduced to one third of the operational length of such a walking aid.

2. Description of the Related Art

Many types and forms of vertical supports have been developed in the related areas of the art of the present invention. Poles, rods, canes and crutches have all been designed in ways that allow them to be reduced in size. However, there are several shortcomings in both the production and operation aspects of these inventions that would be desirable to cure.

U.S. Pat. No. 3,635,233 issued Jan. 18, 1972 to Robertson, shows a folding cane or crutch. A tension cord is attached to the top and bottom tubular segments and runs through any intermediate segments. The joints between segments are formed by male and female fittings integral to the tubular segments. Robertson describes very narrowly the structure of the male/female fittings and emphasizes that they are to be integral to the tubular segments. The cane in Robertson is adjusted to a limited extent for height by changing the position of the hand grip as seen in FIG. 6. Because the device in Robertson is a single vertical support, there is no provision for minimizing or accomodating the torque exerted on the support.

The two U.S. Pat. Nos. to Hyman, No. 3,730,544 issued May 1, 1973 and Re. No. 28,067 issued July 9, 1974, show collapsible ski pole and rod structures. Hyman uses male/female type fittings generally similar to Robertson. A flexible tether cord runs the length of the pole. Mechanical cocking and locking means are provided for applying tension to the cord, thus locking the tubular segments into a linear configuration. Due to the nature of the devices shown in Hyman's two patents, naturally there is no way to adjust the vertical height of either device. Like Robertson, the Hyman patents do not disclose any means for minimizing torsional forces.

U.S. Pat. No. 3,655,297 issued to Bolen, Jr. et al. on Apr. 11, 1972 discloses a coupling or joint for folding tubular parts—here, parts of a paddle. A single directional, hinged plug is anchored into one tube. The other end is slidably located in the second tube. Mounted at this second end is a screw threaded at both ends and narrower between the threadings. A nut is anchored inside the second tube. To secure the two tubes together, one pushes the plug into the second tube and screws the adjacent threading into the internal nut until the device is secure. Again, no means are shown for dealing with the torsional forces created when the device's supporting means is twisted.

A spring-loaded folding cane is shown in U.S. Pat. No. 4,527,579 issued to Knotter et al. on July 9, 1985. A relatively elaborate hinging joint is locked by the operator when a spring-loaded locking ring 33 is slipped over the axially aligned joint segments. To unlock the device in Knotter, the user pulls the locking ring up along the device's shaft against the biasing of the spring, and then, while holding the ring clear of the joint, folds the shaft. Once again, the problem of torsional forces is not addressed due to the nature of the device.

U.S. Pat. No. 3,886,962 issued to Diamontis on June 3, 1975 shows a collapsible crutch using a telescoping hinged joint and a relatively complex series of holes, buttons and slots. A pair of identical latch buttons are moved along slots on the two tubular elements of the crutch to release the hinges, allowing the crutch to be folded. A mechanically specific structure is used to accomplish locking. Diamontis provides for adjustability by making the arm rest 5 adjustable by means of locking buttons 8. Diamontis specifically states that the crutch user needs another person to assist in adjusting the height using the disclosed structure since two lock buttons must be maintained in a depressed position while the arm rest is pulled out.

Finally, two U.S. Pat. Nos. 4,253,478 to Husa issued Mar. 3, 1981 and 4,437,480 issued Mar. 20, 1984, show a folding crutch. A hinged plug is anchored to the lower tube of the crutch, while being slidable within the upper tube. To secure the two tubular segments, one pushes the plug up into the upper segment until a button locks the joint. The later Husa patent adds reinforcing rings outside the joint. Husa does not disclose any means for adjusting the height of the crutch nor dealing with torquing of the lower, single tube element.

Of the above patents, only Diamontis shows a collapsible crutch having more than one collapsible tubular member. All others show only a unitary folding or collapsing vertical support. Diamontis requires a pair of two-part locking mechanisms to assist the user in folding the crutch when not in use and also requires two people to adjust the operational height. Several of the other patents disclose aids that a user can fold without assistance, but, they sacrifice the added stability of having more than one vertical support. A two support walking aid that could be both adjustable and reducible by the user alone would therefore be a significant advancement in the art of reducible walking aids.

OBJECTS AND SUMMARY OF THE INVENTION

It is a primary object of the present invention to provide a reducible walking aid that is easily reduced in size and easily restored to its operating structure by the user without assistance.

It is another object of the present invention to provide a reducible walking aid that does not require any mechanical locking or unlocking means.

It is a further object of the present invention to provide an adjustable and reducible walking aid that is easily produced and has fewer moving or mechanical parts than devices in the related art.

It is yet a further object of the present invention to provide a reducible walking aid that, using one set of elements, combines the means for easily adjusting the operational height of the walking aid to accomodate different users with the means for reducing the size of the walking aid for the times when the aid is not in use.

It is still a different object of the present invention to provide a reducible walking aid that is easily adjustable for a wide variety of user physiques.

How these and other objects of the invention are accomplished will be described with reference to the following description of the preferred embodiment of the invention taken in conjuction with the FIGURES.

Generally, however, the objects of the present invention are accomplished with a reducible walking aid that incorporates three bitubular sections in slidable engagement with one another. The first and third sections are connected via a pair of elastic cables attached to slidable, bidirectional hinge elements anchored to the near ends of the first and third elements. The second bitubular section is located between the first and third sections, with the cables running through the tubes of the second section. To reduce the size of the walking aid, one pulls in opposite directions on the first and second bitubular sections. When the slidable, bidirectional hinge element has cleared the second section and can go no further due to limiting means attached to the hinge elements, the first section is folded over the second section in any direction. The third section is folded in a similar manner. To restore the walking aid to its original operating size, one grasps the folded first and third sections and opens them until they are in generally axial alignment with the second section, at which time the first and third sections slide into the second by means of inward biasing means, to provide a rigid vertical support and set the operational height adjustment automatically. Means are also provided for adjusting the overall height of the walking aid both below and above the adjustable hand grip and thereby to simultaneously accomodate the height and armlength requirements of an individual user.

Other variations, applications and modifications of the present invention may appear to those skilled in the art after reading the specification. Any descriptions herein are illustrative only and other embodiments are deemed to fall within the scope of the present invention if they fall within the scope of the claims which follow the description of the preferred embodiment.

DESCRIPTION OF THE PREFERRED EMBODIMENT

Figure 1:
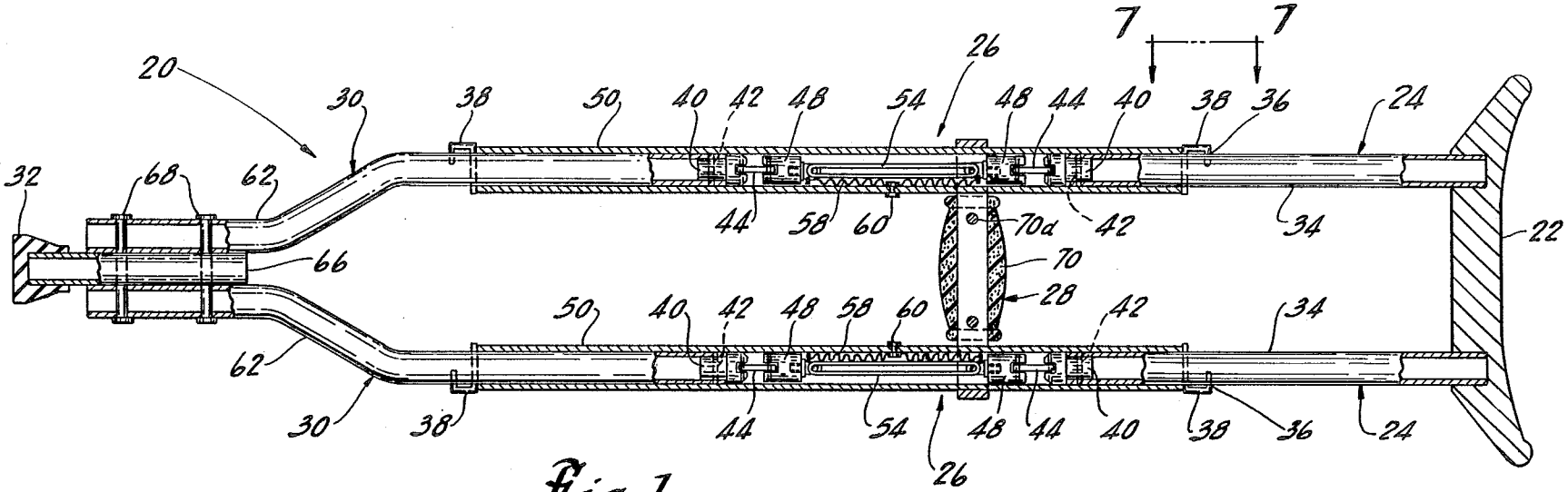
FIG. 1 is a general plan view of an orthopedic crutch constructed using the present invention.

The preferred embodiment of the present invention is generally shown in FIG. 1. A crutch 20 consists generally of an arm rest 22, a first bitubular section 24, a second bitubular section 26 including a hand grip 28, a third bitubular section 30 and a friction pod 32. Arm rest 22 and pod 32 are of conventional construction and are well known in the art.

Figure 2:
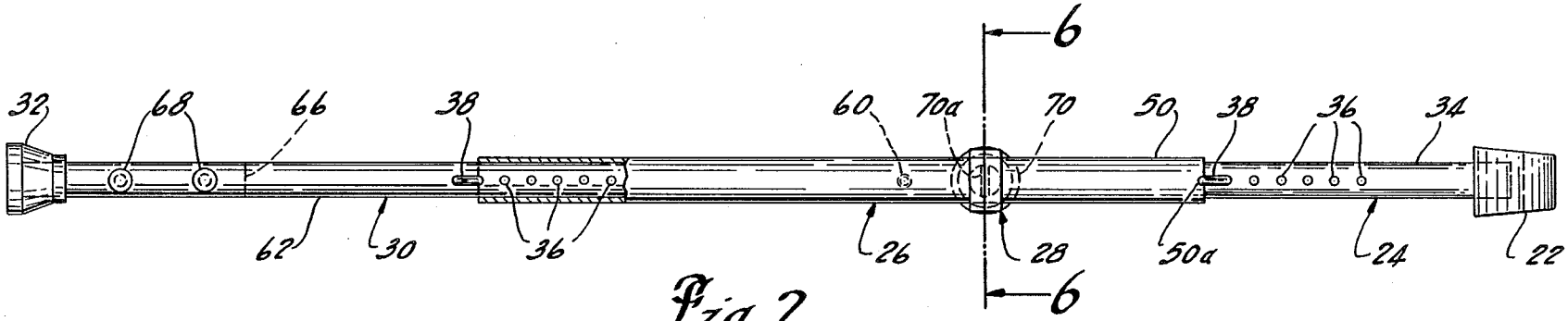
FIG. 2 is a side view of the crutch of FIG. 1.
Figure 3:
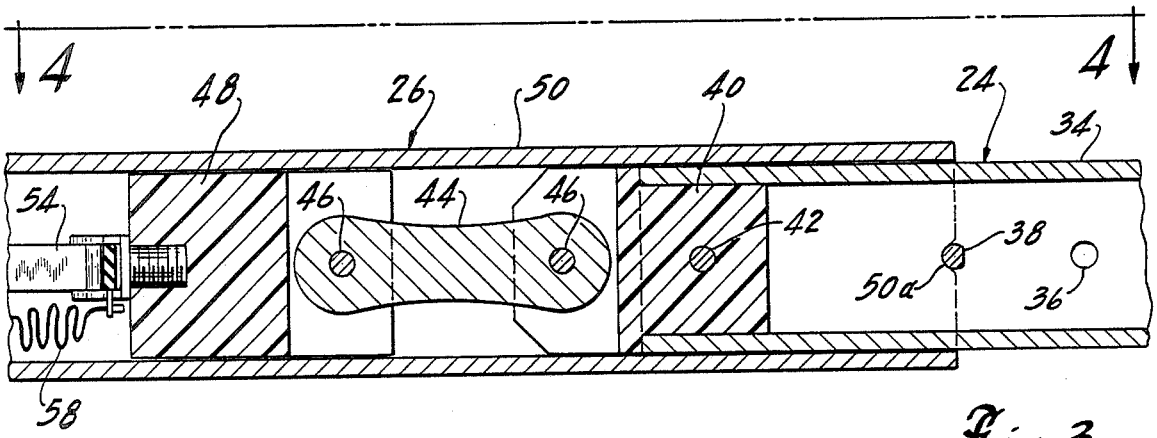
FIG. 3 is a cut-away view of one hinge element of the crutch of FIG. 1.
Figure 4:
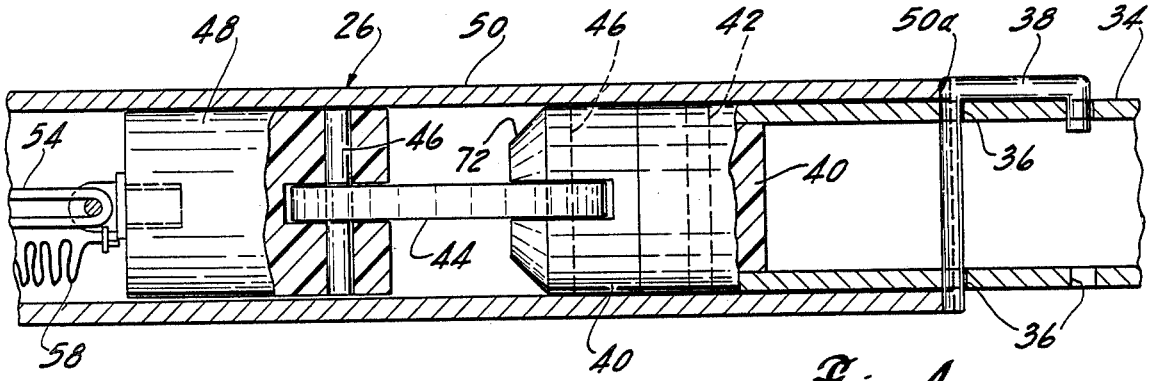
FIG. 4 is another cut-away view of one hinge element of the crutch taken along the line 4—4 of FIG. 3.

The first bitubular section 24 consists of a pair of identical hollow tubes 34 the upper ends of which are mounted to arm rest 22 in any conventional fashion. The arm rest assists in minimizing the torsional forces that are exerted on the crutch when it is twisted in use as well as providing rigid support means for the tubes 34 of first section 24. A cushion (not shown) of rubber or other pliable material is typically placed over the arm rest 22 to provide for the user's comfort. As seen in FIG. 2, each of the tubes 34 has a number of holes 36 drilled through it. These holes are capable of holding pins 38, the purpose of which will be described in more detail below. The lower ends of tubes 34 have anchored hinge elements 40 attached to the inner tubular surfaces. The hinge elements 40 are anchored by any suitable means such as by the compression pins 42 seen in FIGS. 3 and 4. As also seen in FIGS. 3 and 4, each bracket 44 is pivotably secured by pivot pins 46 to both anchored element 40 and mobile element 48.

The mobile elements 48 are slidable within tubes 50 of the second section 26. Tubes 50 are of slightly larger diameter than tne tubes 34 so that tubes 34 of first section 24 can slide into coaxial engagement with the opposing tubes 50 of second section 26. The hinging configuration of first section 24 and second section 26 is symmetrically repeated between the third section 30 and second section 26.

Figure 5:
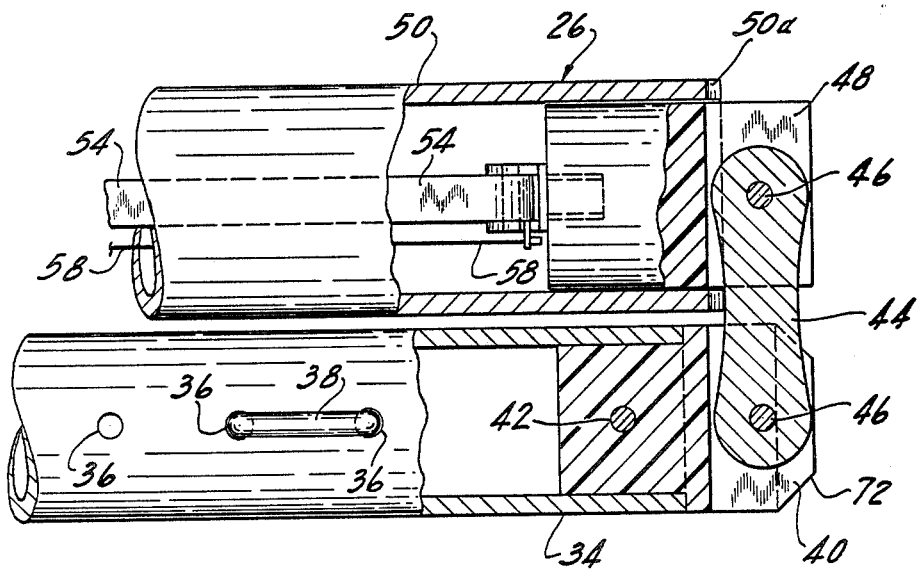
FIG. 5 is the hinge element of FIG. 3 as seen when the crutch is in its collapsed position.

The upper end of each tube 62 of third section 30 has anchored thereto a hinge element 40 identical to the anchored hinge element 40 of first section 24. Once again, as seen in FIG. 5, a bidirectional bracket 44 pivotally connects the anchored element 40 to a mobile element 48. Compression pins 42 and pivot pins 46 are again used in an identical fashion. In the preferred embodiment, longitudinally opposing pairs of mobile elements 48 are connected via an elastic cable 54 which, when the crutch is in its operational configuration, extends between mobile elements 48 within tube 50. Elastic cable 54, when in this position, provides a slight bias of the two modile elements 48 toward one another. This slight bias is adequate to keep the crutch in its operational position when it is lifted off the ground. Elastic cables 54 are attached to the sliding hinge elements 48 in any suitable manner. In an alternate embodiment of the present invention, other biasing means, such as a spring, may be substituted for the cable 54 of the preferred embodiment. One end of a limiting wire 58 is attached to the hinge element 48. The other end of limiting wire 58 is secured with a rivet 60 to the tube 50 of second section 26. The wire 58 thus limits the separation between the crutch sections 24, 30 as they are being pulled apart so as to allow exposure of only enough of the hinges to permit folding. It should be noted here that the hinges, the limiting wire and elastic strap are always isolated from the weight of the user. The only stress to which these elements are subjected is that of the weight of the lower part of the crutch itself and the actual elastic force created by the elastic cable 54.

The third bitubular section 30 consists of two tubes 62 that are parallel at the upper end of section 30, then converge inwardly before again becoming parallel, though closer together, near the bottom of section 30. Tubes 62, like tubes 34 of section 24, have a number of holes 36 that extend through tubes 62 sideways, as seen in FIG. 2. Tubes 62 and tubes 34 are of the same diameter in the preferred embodiment of the present invention. At the lower end of section 30, a single tubular brace 66 is anchored between the tubes 62. Brace 66 is anchored by a pair of bolts 68 which further assist in accomodating torsional forces and provide a rigid support for the tubes 62 of the third section 30. At the bottom end of brace 66 is a friction pod 32.

Figure 6:
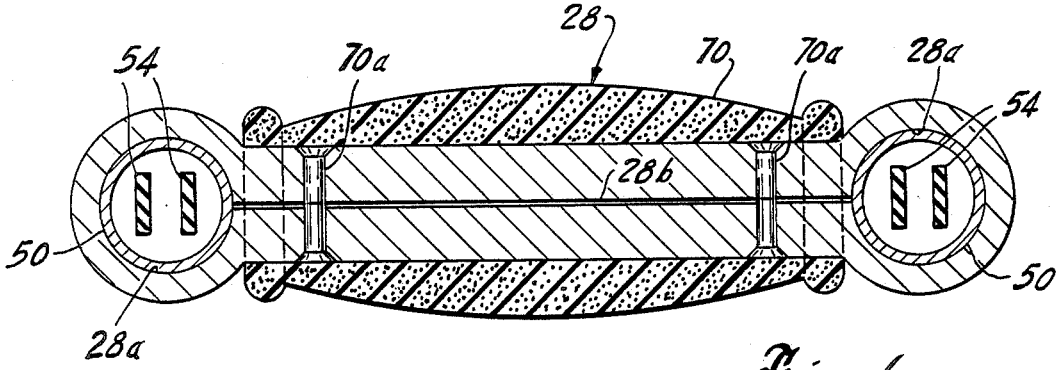
FIG. 6 is a cut-away view of the hand grip taken along the line 6—6 in FIG. 2.

FIG. 6 illustrates the means for attaching the hand grip 28 to the tubes 50 of the second section 26. The grip 28 is a single piece with two holes 28*a* and a connecting slot 28*b*. The two holes 28*a* are of a configuration so that they maintain the tubes 50 in parallel alignment and prevent excessive twisting of the crutch when it is in its operational position. Two clamps 70*a* join opposing faces of the slot 28*b* to frictionally engage the tubes 50 so that a stable but infinitely adjustable grip is formed. Grip 28 provides still further anti-torquing means for those situations in which the crutch is twisted as well as a rigid support for the tubes 50. An overlay 70 of rubber or other pliable material is usually provided to increase the comfort and frictional handling characteristics of the grip.

Figure 7:
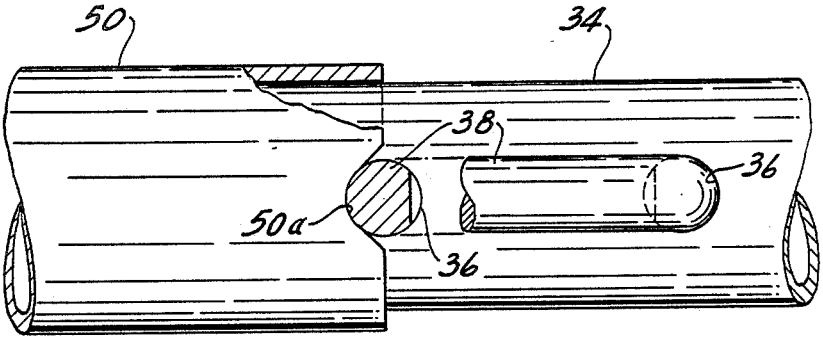
FIG. 7 is a detailed view of the weight support apparatus of the present invention.

The elements of the present invention that actually support the weight of the user are the pins 38, the holes 36, and the tubes 50 of the second section 26. As seen in FIG. 7, pins 38 provide opposing support means on either end of the tubes 50 of the second section 26. Each tube 50 has small deformations 50*a* in both ends into which pins 38 fit snuggly. The use of pins 38 with deformations 50*a* again assists in providing torsional stability for the crutch in its operational position. Also, the load on a pin 38 is distributed over a larger area and thereby reduces tne bearing stresses on the tube 50 at the point of contact. This system is extremely reliable since there is always a minimum force from the bias of the elastic strap 54 on each pin 38 to keep it in place. Unlike the crutches of earlier patents, this device requires no locking mechanism for it to remain in either a collapsed or operational configuration. A large rubber band or clip of some kind may be used to hold the crutch in its collapsed position once it is folded and is to be stored.

Figure 8:
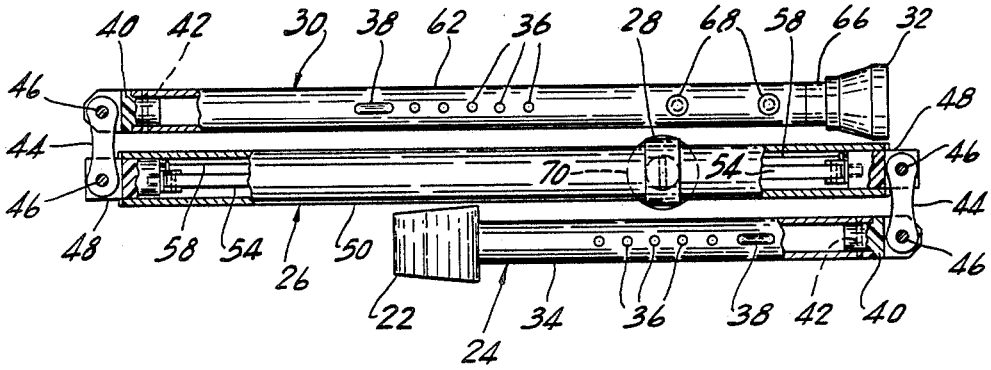
FIG. 8 is a plan view of the crutch of FIG. 1 in its collapsed position.

The crutch 20 in FIG. 1 may also be easily, quickly and reliably adjusted by the user. When crutch 20 is in its collapsed position, as seen in FIG. 8, pins 38 may be removed and inserted in different holes 36 in tubes 34 and tubes 62. First, the pins 38 in section 24 are adjusted to set the proper distance from the user's underarm to hand, generally leaving about two inches clearance between the arm rest 22 and the user's underarm. The pins 38 in third section 30 are then adjusted to ensure correct overall length of the crutch for a given user. The hand grip 28 can also be continuously adjusted to ensure maximum comfort for the user. Unlike some other collapsible crutches disclosed, the present invention can be adjusted by the user, typically a disabled individual, without the assistance of another person or a great deal of force or strength. This permits the individual to function more independently.

A disabled individual can also fold and unfold the crutch 20 without any assistance. When the crutch 20 is in its operational configuration as seen in FIG. 1, folding is accomplished by grasping the first section 24 and second section 26 and pulling them away from each other. Once the hinge brackets 44 are generally clear of the tubes 50, the first section 24 is folded over the second section 26 in one direction. The third section 30 is folded in the opposite direction in a similar fashion to accomplish the complete folding of the crutch. The resulting collapsed position is illustrated in FIG. 8.

When the user desires to open the crutch 20 to its operational position as seen in FIG. 1, he or she merely pivots the first section 24 and third section 30 into general alignment with the second section 26. The mobile elements 40 have beveled surfaces 72 to help guide the elements 40 back into their respective tubes. An alternative method for opening the collapsed crutch 20 is to grasp the arm rest 22 and let the sections fall toward the ground and thus into general coaxial alignment with each other at which point the sections will automatically telescope together under the biasing force of the elastic cable 54.

As can be appreciated from the above discussion, a disabled individual can easily adjust, fold and unfold the crutch 20 of the present invention or any other similarly constructed device without assistance from another person. Variations, modifications and other applications will become apparent to those skilled in the art. For example, a prestressed unitary hinge may be substituted for the hinge configuration of the preferred embodiment. Therefore, the above description of the preferred embodiment is to be interpreted as illustrative rather than limiting. The scope of the present invention is limited only by the scope of the claims that follow.

We claim:

1. A latchless walking aid having integral adjusting and folding means, including at least three tubular sections, comprising:

a first section having one or more tubular members each having a first bidirectional hinge element anchored at one end thereof, a second section having the same number of tubular members as said first section, each of said tubular members of said second section designed to coaxially and slidably accept one tubular member of said first section and its said first hinge element to a preselected depth within said tubular member of said second section, said first section being attached to said second section by limiting means designed to limit the separation of said sections;

a third section having the same number of tubular members as said second section, said third section having a second bidirectional hinge element anchored at one end thereof, each of said tubular members of said second section designed to coaxially and slidable accept one tubular member of said third section and its said second hinge element to a preselected depth within said tubular member of said second section, said third section being attached to said second section by limiting means designed to limit the separation of said sections;

means connecting said first and second hinge elements designed to bias said hinge elements toward one another, said biasing means being generally enclosed by and passing through said second section;

wherein said means for permitting said second section to accept said first and third sections to preselected depths includes a plurality of holes in said first and third sections and pins insertable therein, said pins being further engageable with the ends of said tubular members of said second section.

2. The walking aid as recited in claim 1 wherein said first, second and third sections each comprise two tubular members.

3. The walking aid as recited in claim 1 wherein said first hinge elements each comprise one anchored element fixedly attached to each of said tubular members of said first section, a mobile element slidable within one tubular element of said second section, and a bracket pivotally connecting each said mobile element and anchored element and said second hinge elements each comprise one anchored element fixedly attached to each of said tubular members of said third section, a mobile element slidable within one tubular element of said second section, and a bracket pivotally connecting each said mobile element and anchored element.

4. The walking aid as recited in claim 3 wherein said limiting means between said first and second sections is a wire one end of which is attached to said hinge element of said first section and the other end of which is attached to the tubular member of said second section and said limiting means between said third and second sections is a wire one end of which is attached to said hinge element of said third section and the other end of which is attached to the tubular member of said second section.

5. The walking aid as recited in claim 1 wherein each of said biasing means is an elastic strap passing through the tubular member of said second section positioned between the tubular member of said first section and the tubular member of said third section to which said elastic strap is attached.

6. The walking aid as recited in claim 1 wherein each of said biasing means is a spring passing through the tubular section of said second section positioned between the tubular member of said first section and the tubular member of said third section to which said spring is attached.

7. The walking aid as recited in claim 1 wherein said walking aid is an orthopedic crutch further comprising an upper arm rest mounted on the end of said first section not having hinge elements attached thereto, an infinitely adjustable hand grip attached between said tubular members of said second section, and a pod element designed to enhance the frictional stability of said walking aid on the surface on which said aid is used.

8. The walking aid as recited in claim 7 wherein said hand grip comprises a member designed to frictionally engage said tubular members of said second section so as to hold said hand grip in place.

9. A latchless orthopedic crutch having integral adjusting and folding means, including three bitubular sections, comprising:

a first section having two tubular members each having a first bidirectional hinge element anchored at one end thereof;

a second section having two tubular members, each of said tubular members of said second section designed to coaxially and slidably accept one of said tublar members of said first section and its said first hinge element to a preselected depth within said tubular member of said second section, said first section being attached to said second section by limiting means designed to limit the separation of said first section and said second section;

a third section having two tubular members, each tubular member of said third section having a second bidirectional hinge element anchored at one end thereof, each of said tubular members of said second section designed to coaxially and slidably accept one tubular member of said third section and its said second hinge element to a preselected depth within said tubular member of said second section, said third section being attached to said second section by limiting means designed to limit the separation of said sections;

means connecting said first and second hinge elements designed to bias said hinge elements toward one another, said biasing means being generally enclosed by and passing through said second section;

wherein said means for permitting said second section to accept said first and third sections to preselected depths includes a plurality of holes in said first and third sections and pins insertable therein, said pins being further engageable with the ends of said tubular members of said second section.

10. The walking aid as recited in claim 9 wherein said first hinge elements each comprise one anchored element fixedly attached to each of said tubular members of said first section, a mobile element slidable within one tubular element of said second section, and a bracket pivotlaly connecting each said mobile element and anchored element and wherein said second hinge elements each comprise one anchored element fixedly attached to each of said tubular members of said third section, a mobile element slidable within one tubular element of said second section, and a bracket pivotally connecting each said mobile elememt and anchored element.

11. The walking aid as recited in claim 10 wherein said limiting means between said first and second sections is a wire one end of which is attached to said hinge element of said first section and the other end of which is attached to the tubular member of said second section and said limiting means between said third and second sections is a wire one end of which is attached to said hinge element of said third section and the other end of which is attached to the tubular member of said second section.

12. The walking aid as recited in claim 11 wherein each of said biasing means is an elastic strap passing through the tubular section of said second section which is located between the tubular member of said first section and the tubular member of said third section to which said elastic strap is attached.

13. The walking aid as recited in claim 11 wherein each of said biasing means is a spring passing through the tubular member of said second section which is located between the tubular member of said first section and the tubular member of said third section to which said spring is attached.

14. The walking aid as recited in claim 11 wherein said walking aid is an orthopedic crutch further comprising an upper arm rest mounted on the end of said first section not having hinge elements attached thereto, an infinitely adjustable hand grip attached between said tubular members of said second section, and a pod element designed to enhance the frictional stability of said walking aid on the surface on which said aid is used.

15. The walking aid as recited in claim 14 wherein said hand grip comprises a member designed to frictionally engage said tubular members of said second section so as to hold said hand grip in place.

16. A latchless orthopedic crutch having integral adjusting and folding means, including three bitubular sections, comprising:

a first section having two tubular members each having a first bidirectional hinge element anchored at one end thereof and an arm rest mounted on the other end thereof;

a second section having two tubular members and a hand grip mounted therebetween, each of said tubular members of said second section designed to coaxially and slidably accept one of said tubular members of said first section and its said first bidirectional hinge element to a preselected depth within said tubular member of said second section, said first hinge element of said first section being attached to said tubular member of said second section by a wire designed to limit the separation of said sections, said hand grip comprising a member designed to frictionally engage said tubular members of said second section so as to hold said hand grip in place;

a third section having two tubular members, each tubular members of said third section having a second bidirectional hinge element anchored at one end thereof and a pod element designed to enhance the frictional stability of said walking aid on the surface on which said said is used mounted at the other end, each of said tubular members of said second section designed to coaxially and slidably accept one tubular member of said third section and its said second bidirectional hinge element to a preselected depth within said tubular member of said second section, said second hinge element of said third section being attached to said tubular member of said second section by a wire designed to limit the separation of said sections;

an elastic strap connecting each pair of said first and second bidirectional hinge element designed to bias said hinge elements toward one another, said elastic strap being generally enclosed by and passing through the tubular member of said second section positioned between tubular members of said first and third sections;

wherein said means for permitting said second section to accept said first and third sections to preselected depths includes a plurality of holes in said first and third sections and pins insertable therein, said pins being further engageable with the ends of said tubular members of said second section.

17. The walking aid as recited in claim 16 wherein said first hinge elements each comprise one anchored element fixedly attached to each of said tubular members of said first section, a mobile element slidable within one tubular element of said second section, and a bracket connecting each said mobile element and anchored element and wherein said second hinge elements each comprise one anchored element fixedly attached to each of said tubular members of said third section, a mobile element slidable within one tubular element of said second section, and a bracket pivotally connecting each said mobile element and anchored element.

18. The walking aid as recited in claim 1 in combination with a hand grip designed to be used with a bitubular orthopedic crutch, said grip comprising:

a central grip member haviing two cylindrical holes located at either end thereof, the longitudinal axis of said holes being parallel and being designed to accept said tubular members of said crutch therethrough, said holes being connected by a planar slit, the slit being in the plane defined by the two parallel longitudinal axis of the holes, thus creating two internally opposing faces in said central grip member between the holes;

elongate, cylindrical clamping means extending through said central grip member, the longitudinal axis of said clamping means being perpendicular to the opposing internal faces of said central member, and said clamping means being adjustable so that said grip may be moved along through an infinite number of positions along said tubular members of said crutch when said clamping means is loosened and so said grip is in immobiile frictional engagement with the tubular members of said crutch when said clamping means is tightened.

19. The method for folding an adjustable and reducible latchless walking aid having a first section attached to a second section by a first bidirectional hinge slidable within said second section, said first and second sections being in a first position wherein said first section is telescopically held within said second section, a third section attached to said second section by a second bidirectional hinge slidable within said second section, said second and third sections being in a first position wherein said third section is telescopically held within said second section, and wherein said first and second hinges are biased toward one another by biasing means connected thereto, said method comprising the steps of:

(a) grasping said first section and said second section;

(b) pulling said first section and said second section apart until said first hinge is exposed;

(c) pivoting said first section at said first hinge to a second position wherein said first section has been pivoted about 180° so that said first section is lying against said second section;

(d) grasping said second section and said third section;

(e) pulling said second section and said third section apart until said second hinge is exposed;

(f) pivoting said third section at said second hinge to a second position wherein said third section has been pivoted about 180° in a direction opposite to that in which said first section was pivoted.

20. The method for folding an adjustable and reducible latchless orthopedic crutch having a first bitubular section attached to a second bitubular section by a first bidirectional hinge pair slidable within the tubes of said second section, said first and second sections being in a first position wherein the tubes of said first section are telescopically held within the tubes of said second section, a third bitubular section attached to said second bitubular section by a second bidirectional hinge pair slidable within said second section, said second and third sections being in a first posiion wherein the tubes of said third section are telescopically held within the tubes of said second section, and wherein said first and second hinge pairs are biased toward one another by biasing means connected thereto, said method comprising the steps of:

(a) grasping said first section and said second section;

(b) pulling said first section and said second section apart until said first hinge pair is exposed;

(c) pivoting said first section at said first hinge pair to a second position wherein said first section has been pivoted about 180° so that said first section is lying against said second section;

(d) grasping said second section and said third section;

(e) pulling said second section and said third section apart until said second hinge pair is exposed;

(f) pivoting said third section at said second hinge to a second position wherein said third section has been pivoted about 180° in a direction opposite to that in which said first section wa pivoted.

* * * * *